US009103190B2

(12) United States Patent
O'Rourke et al.

(10) Patent No.: US 9,103,190 B2
(45) Date of Patent: Aug. 11, 2015

(54) INERT GAS SUPPLY EQUIPMENT FOR OIL AND GAS WELL OPERATIONS

(75) Inventors: Timothy O'Rourke, Calgary (CA); Ronald Dant, Duncan, OK (US)

(73) Assignee: GasFrac Energy Services Inc., Calgary, Alberta ( * ) Notice: Subject to any disclaimer, the term of this patent is extended or adjusted under 35 U.S.C. 154(b) by 646 days.

(21) Appl. No.: 13/471,279

(22) Filed: May 14, 2012

(65) Prior Publication Data

US 2013/0299159 A1 Nov. 14, 2013

(51) Int. Cl.

| | |
|---|---|
| ***E21B 36/00*** | (2006.01) |
| ***E21B 43/24*** | (2006.01) |
| ***E21B 43/00*** | (2006.01) |
| ***E21B 43/26*** | (2006.01) |

(52) U.S. Cl.

CPC ..... *E21B 43/00* (2013.01); *E21B 43/26* (2013.01)

(58) Field of Classification Search

CPC ..... E21B 43/26; E21B 43/164; E21B 43/16; E21B 43/168; E21B 43/166; E21B 43/00

USPC ..... 166/57, 90.1, 308.1, 308.6

See application file for complete search history.

(56) References Cited

U.S. PATENT DOCUMENTS

| | | | | |
|---|---|---|---|---|
| 3,842,910 | A | 10/1974 | Zingg | |
| 4,126,181 | A * | 11/1978 | Black | 166/280.2 |
| 4,701,270 | A * | 10/1987 | Bullen et al. | 507/203 |
| 5,883,053 | A * | 3/1999 | Tudor | 507/102 |
| 5,990,052 | A | 11/1999 | Harris | |
| 2006/0065400 | A1 * | 3/2006 | Smith | 166/308.1 |
| 2007/0204991 | A1 * | 9/2007 | Loree et al. | 166/280.1 |
| 2009/0194273 | A1 * | 8/2009 | Surjaatmadja et al. | 166/250.1 |
| 2009/0308613 | A1 * | 12/2009 | Smith | 166/305.1 |
| 2010/0038077 | A1 * | 2/2010 | Heilman et al. | 166/250.01 |

OTHER PUBLICATIONS

International Search Report and Written Opinion mailed Aug. 20, 2013, issued in corresponding International Application No. PCT/CA2013/050357, filed May 8, 2013, 7 pages.

* cited by examiner

*Primary Examiner* — Kenneth L Thompson
*Assistant Examiner* — Michael Wills, III
(74) *Attorney, Agent, or Firm* — Christensen O'Connor Johnson Kindness PLLC

(57) ABSTRACT

An apparatus for the supply of inert gas at a well site, the apparatus comprising one or more pressure vessels containing liquefied inert gas, a heat exchanger, one or more units of fracturing equipment connected to a manifold, a submersible pump in each of the one or more pressure vessels, each submersible pump being connected to supply liquefied inert gas to a supply line that passes through the heat exchanger and the supply line being connected to supply inert gas vaporized by the heat exchanger to the manifold.

15 Claims, 2 Drawing Sheets

INERT GAS SUPPLY EQUIPMENT FOR OIL AND GAS WELL OPERATIONS

TECHNICAL FIELD

Inert gas supply equipment for oil and gas well operations.

BACKGROUND

For the safe LPG fracturing of oil and gas wells, as for example proposed by the inventor Dwight Loree in his Patent Cooperation Treaty application no. PCT/CA2007/000342 published Sep. 7, 2007 and related applications, large volumes of nitrogen or other inert gas such as argon are required for delivery to fracturing equipment such as blenders and bulkers used at the well site. A design previously used by GasFrac Energy Services Inc. used high pressure pumps of the centrifugal type, pumping high pressure (10 k psi), low volume (50 cm3/min), which proved inadequate for intended use in the blenders and bulkers and needed to be supplemented by N2 tube trailers. Additional equipment requiring manual operation caused more people to be within the hazard area at the well site. The inventor investigated commercial equipment suitable for the purpose and found nothing available, and therefore invented what is disclosed in this document.

SUMMARY

There is provided an apparatus for the supply of inert gas at a well site, the apparatus comprising one or more pressure vessels containing liquefied inert gas, a heat exchanger, one or more units of fracturing equipment connected to a manifold, a submersible pump in each of the one or more pressure vessels, each submersible pump being connected to supply liquefied inert gas to a supply line that passes through the heat exchanger and the supply line being connected to supply inert gas vaporized by the heat exchanger to the manifold. In various embodiments, there may be included any one or more of the features disclosed in this document.

BRIEF DESCRIPTION OF THE FIGURES

Embodiments will now be described with reference to the figures, in which.

DETAILED DESCRIPTION

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims. For each of the pressure transmitters and temperature transmitters shown in the figures, the associated instrumentation includes a sensor and signal transmitter and may include a pressure or temperature indicator.

Figure 1:
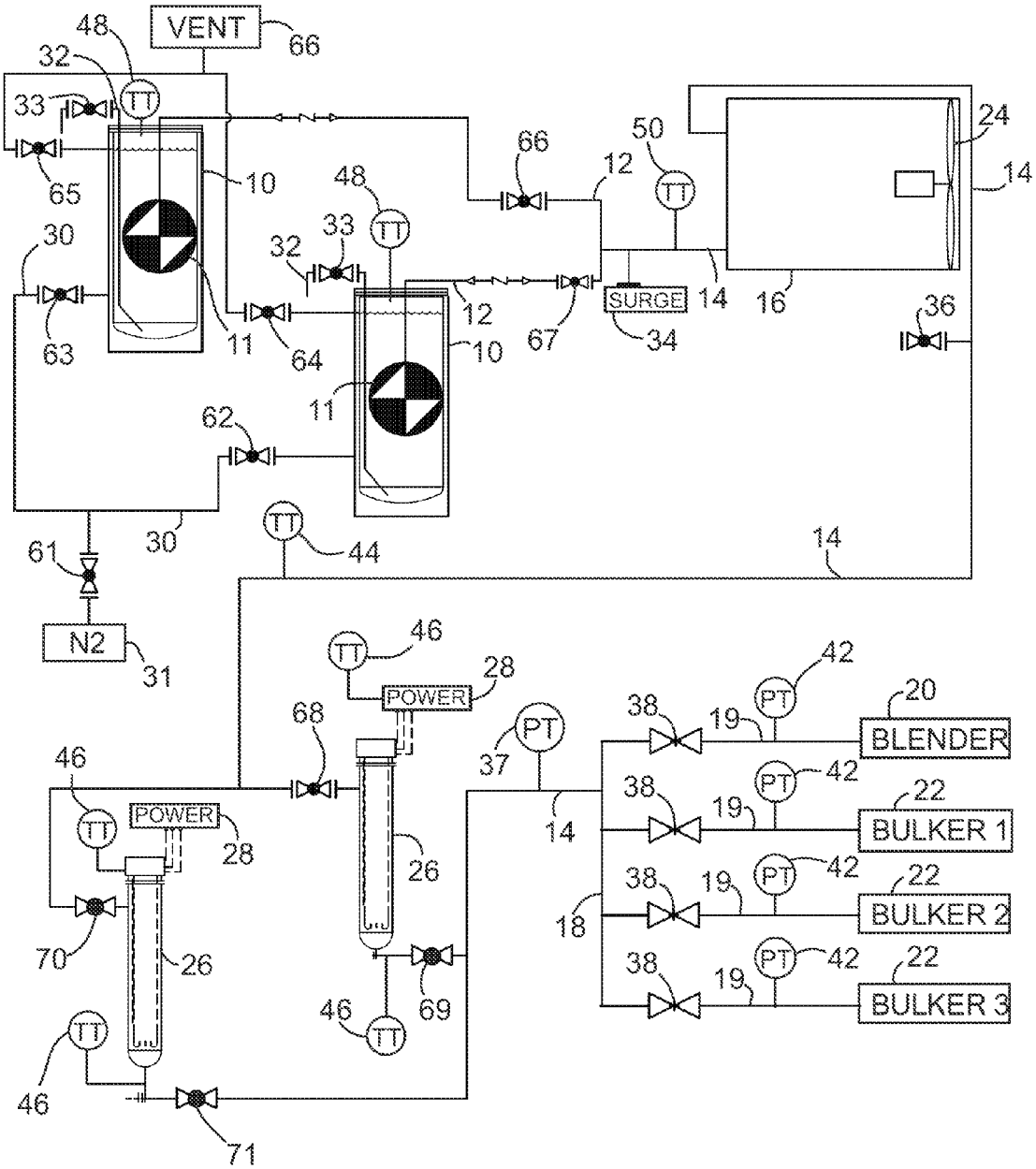
FIG. 1 is a piping and instrumentation diagram of apparatus for the supply of inert gas at a well site.
Figure 2:
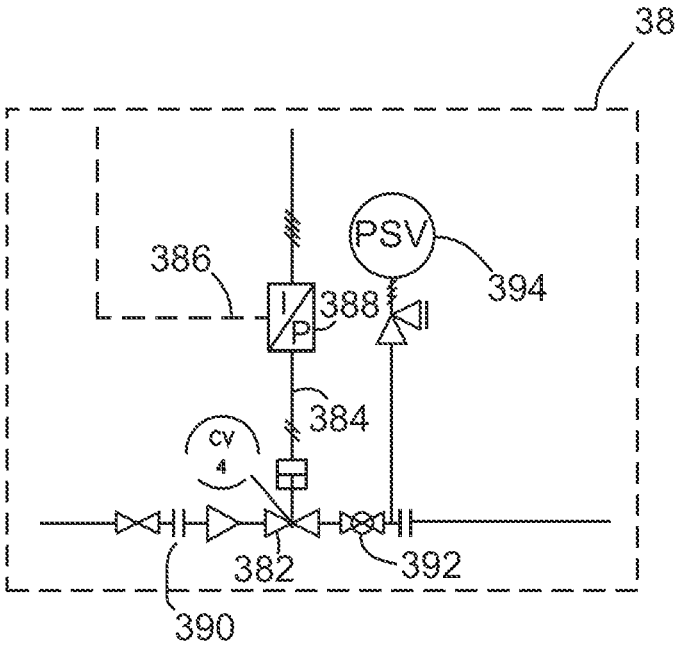
FIG. 2 shows a proportional valve arrangement for use in the apparatus of FIG. 1.

As shown in FIG. 1, an apparatus for the supply of inert gas at a well site includes one or more pressure vessels 10 containing liquefied inert gas that are supplied from an inert gas source 31. The vessels 10 may have a much smaller volume than the source 31. The liquefied inert gas may be for example nitrogen or argon. By inert is meant that the gas is sufficiently non-reactive as to be useful for fire prevention and suppression. Submersible pumps 11 in each of the pressure vessels 10 are connected via one or more liquid supply lines 12 to supply liquefied inert gas to a supply line 14 that passes through a heat exchanger 16. The supply line 14 carries inert gas vaporized by the heat exchanger to a manifold 18. The manifold 18 supplies one or more units of fracturing equipment through lines 19 and proportional valve arrangements 38. The fracturing equipment may be for example a blender 20 for proppant addition and bulkers 22 for supply of fracturing fluid such as LPG for use in an LPG fracturing process. An exemplary valve arrangement 38 is shown in FIG. 2, which may be used for each valve arrangement 38. The exemplary valve arrangement 38 of FIG. 2 comprises a proportional valve 382, which is pneumatically actuated through line 384 under control of an electrical signal supplied from line 386 through current to pneumatic control 388. Valves 390 and 392 may be used to isolate the proportional valve 382, and a pressure safety valve 394 is also provided on the equipment side of the valve arrangement 38. The vaporized inert gas may be used as a source of power for the pneumatic control 388.

The heat exchanger 16 comprises a chamber with a fan 24 for blowing ambient air across the supply line 14, which follows a path through the heat exchanger 16 that is typical of heat exchangers. One or more heaters such as electric heaters 26 powered by respective power supplies 28 are provided on the supply line 14 after the heat exchanger 16. The heaters 26 may not be required in all embodiments, but are useful for increasing gas pressure in cold climates, such as northern parts of North America.

Gas pressure and flow rates of gas to the process equipment 20, 22 is monitored and the pump rates of the submersible pumps 11, the fan speed of the fan 24, and the electrical heat produced by the heaters 26 is controlled to maintain an adequate pressure of inert gas to the process equipment 20, 22.

The pumps 11 may be for example progressive cavity pumps with a 160 psig sump rating. Inert gas in liquid form is loaded into the pressure vessels 10 through lines 30 from an inert gas source 31, which may comprise one or more N2 transport trailers or trucks. The vessels 10 may be drained through lines 32 and valves 33, or vented through vent 66, which may for example be a return to the N2 source 31 for example the top of a nitrogen transport truck or trailer. A surge connection chamber 34 may be provided on the liquid supply line 14. The heat exchanger 16 may be a commercially available heat exchanger such as a Model AF100A-32H. An automated bleed valve 36 may be provided to reduce pump back pressure on start up. In an example, the supply line 14 may be a 1½ inch supply line when it carries liquid, increasing to a 3 inch, 300 psig to 320 psig main gas line after the heat exchanger 16. The heaters 26 may for example be powered by a 480 VAC/3 phase power supply 28 and the heaters 26 may be 180 kW heaters. Pressure to a blender for an example of LPG fracturing may be at 280 psig through a 2 inch line, and for the bulkers 200 psig through a 2 inch line. The proportional valves 38 may use for example pneumatically operated and electrically controlled valves 382. Duplicate equipment is use for redundancy. Flow rates from pumps and heater settings are maintained automatically to maintain the proper flow for intended uses to keep system pressure delivered through hose reels to the blender(s) and bulkers.

Pressure for the operation of the system is mainly provided by the submersible pumps 11. Pressure of gas supplied along the main flow line 14 is monitored by pressure transmitter 37 and pressure on the lines 19 to the fracturing equipment 20, 22 is monitored by pressure transmitters 42. The pressure transmitters 42 may be located elsewhere such as on the equipment 20, 22 or on the vaporizer side of the lines 19. In the control of the system, an operating pressure for the fracturing equipment 20, 22 is established and pressure increased or decreased by changing the pump speed of the submersible pumps 11 to maintain sufficient total pressure on the line 14 (sensed at 37). The pressure on each line 19 is adjusted by controlling flow through the proportional valves 38. Temperature of the gas in the line 14 is also sensed with temperature transmitter 44 and if the temperature is too low, the heaters 26 are activated to heat the gas in the line 14. Temperature transmitters 46 in the heaters 26 and also at the outlets from the heaters 26 are used to monitor the increase of heat of the gas in line 14 and to ensure that the temperature of the gas from the heaters 26 does not reach too high a value. Internal temperatures sensors in the heaters 26 may also be used to monitor overheating of the heaters 26. Temperature transmitters 48 may be used for some embodiments of pumps 11 to ensure that fluid in the pressure vessels 10 is cold enough that vanes of the pumps 11 clear the pressure vessel walls. The vessels 10 may be charged from a liquid nitrogen source 31 to ensure that the temperature of the fluid in the vessels 10 is cold enough for start up. Temperature transmitter 50 monitors temperature of liquid nitrogen flowing into the heat exchange 16. A controller (not shown) is used to send appropriate control signals to the pumps 11, heaters 26 and proportional valves 38 based on inputs from the transmitters 37, 42, 44, 46, 48 and 50. Various conventional pressure safety valves (not shown) are used throughout the system according to conventional safety practice. Flow in the various lines is also controlled by various motor controlled valves and check valves 61-71, 382, 390 and 392 by the controller (not shown).

As part of the set up of a fracturing operation, the fracturing equipment including the blender 20 and bulkers 22 are installed at the well site along with the vaporizing equipment disclosed in this document, and the connections, represented by the lines in the figure, are made up between the equipment. Standard safety procedures for pressurized equipment are followed including the establishment of a safe zone. Vessels 10 are charged from inert gas source 31 through lines 30 by opening valves 61, 62 and 63. Pressurized fluid may be vented when required from the vessels 10 through valves 64 and 65 and conventional vent 66. Temperature of fluid in the vessels 10 is monitored using temperature transmitters 48 and the pumps only activated when the temperatures are suitable for equipment operation. When the vessels 10 are charged and it is desired to supply pressure to the fracturing equipment 20, 22, valves 61-65 remain open (the N2 source 31 is the main supply), valves 36 and, depending on whether one or both pumps 11 are used and whether one, both or neither of the heaters 26 are used, one or both of valves 66 and 67 are opened, one or both of the valve sets including valves 68, 69 and valves 70, 71 are opened and one or both of pumps 11 are started to establish flow through the heat exchanger 16. Pressure builds up in line 14 until pressure sensed by pressure transmitter 37 reaches a desired level while valves 390 are closed. When the fracturing equipment 20, 22 is ready to receive pressure, the valves 390 and 392 may be opened, the proportional valves 382 set at a suitable opening to produce a desired pressure in the respective lines 19, and pressure supplied to the fracturing equipment 20, 22 may be monitored using pressure transmitters 42. Pump rate of the pumps 11 may be adjusted to provide a desired pressure at pressure transmitters 42. The process may be automated or manual, but automated is preferred.

The embodiments of the invention in which an exclusive property or privilege is claimed are defined as follows:

1. An apparatus for the supply of inert gas at a well site, the apparatus comprising:

one or more pressure vessels containing liquefied inert gas;

a heat exchanger;

one or more units of fracturing equipment connected to a manifold;

a submersible pump in each of the one or more pressure vessels, each submersible pump being connected to supply liquefied inert gas to a supply line that passes through the heat exchanger;

at least a heater on the supply line after the heat exchanger;

the heat exchanger comprising a chamber with a fan for blowing ambient air across the supply line;

the manifold being connected to the one or more units of fracturing equipment through proportional valves; and the supply line being connected to supply inert gas vaporized by the heat exchanger to the manifold.

2. The apparatus of claim 1 in which the at least a heater comprises an electric heater.

3. The apparatus of claim 1 in which the at least a heater comprises plural electric heaters.

4. The apparatus of claim 1 in which there are at least two pressure vessels.

5. The apparatus of claim 4 in which the fracturing equipment comprises LPG fracturing equipment.

6. The apparatus of claim 5 in which the LPG fracturing equipment comprises one or more blenders and one or more bulkers.

7. The apparatus of claim 6 in which the inert gas is nitrogen or argon.

8. An apparatus for the supply of inert gas at a well site, the apparatus comprising:

one or more pressure vessels containing liquefied inert gas;

a heat exchanger;

one or more units of fracturing equipment connected to a manifold;

a submersible pump in each of the one or more pressure vessels, each submersible pump being connected to supply liquefied inert gas to a supply line that passes through the heat exchanger;

at least a heater on the supply line after the heat exchanger; and the supply line being connected to supply inert gas vaporized by the heat exchanger to the manifold.

9. The apparatus of claim 8 in which there are at least two pressure vessels.

10. The apparatus of claim 8 in which the fracturing equipment comprises LPG fracturing equipment.

11. The apparatus of claim 10 in which the LPG fracturing equipment comprises one or more blenders and one or more bulkers.

12. The apparatus of claim 8 in which the inert gas is nitrogen or argon.

13. The apparatus of claim 8 in which the at least a heater comprises an electric heater.

14. The apparatus of claim 8 in which the at least a heater comprises plural electric heaters.

15. The apparatus of claim 8 in which the manifold is connected to the one or more units of fracturing equipment through proportional valves.

* * * * *